US005660219A

United States Patent [19]

Ford et al.

[11] Patent Number: 5,660,219

[45] Date of Patent: Aug. 26, 1997

[54] METHOD AND DEVICE FOR INSTALLING A CORNICE

[75] Inventors: Alan Arthur Ford; Steven Ray Haarer, both of Sturgis; Gary Ray Phelps, Colon, all of Mich.; Michael Edward Fitzgerald, Granger, Ind.

[73] Assignee: Cooper Industries, Inc., Houston, Tex.

[21] Appl. No.: 640,446

[22] Filed: Apr. 30, 1996

[51] Int. Cl.[6] ..... E04F 10/00

[52] U.S. Cl. ..... 160/38

[58] Field of Search ..... 160/19, 38, 39, 160/330, 368.1, 354, 327, 405

[56] References Cited

U.S. PATENT DOCUMENTS

| | | | |
|---|---|---|---|
| 3,378,057 | 4/1968 | Synck . | |
| 4,254,813 | 3/1981 | Vecchiarelli . | |
| 4,254,814 | 3/1981 | Vecchiarelli . | |
| 4,384,605 | 5/1983 | Schaeffer et al. | 160/19 X |
| 4,399,856 | 8/1983 | Anderson . | |
| 4,828,002 | 5/1989 | Ashby | 160/38 |
| 4,921,031 | 5/1990 | Wagner et al. . | |
| 5,062,463 | 11/1991 | Peters . | |
| 5,188,162 | 2/1993 | Simon et al. | 160/38 X |
| 5,331,993 | 7/1994 | Billbury | 160/368.1 X |
| 5,365,994 | 11/1994 | Wheatley et al. | 160/354 |
| 5,505,245 | 4/1996 | Badalamenti | 160/38 |
| 5,520,234 | 5/1996 | Simmons | 160/38 |

*Primary Examiner*—David M. Purol

*Attorney, Agent, or Firm*—Burns, Doane, Swecker & Mathis, LLP

[57] ABSTRACT

A cornice has an elongate frontpiece that has a decorative front side and a back side, an opening in the back side of the frontpiece, and a fastener having a first projection on one side thereof for mounting in the opening of the frontpiece and a second projection on another side thereof for engaging with a headrail so that the frontpiece can be mounted to the headrail by engaging the first projection of the fastener with the frontpiece and engaging the second projection of the fastener with the headrail. The cornice can be installed to the headrail by inserting the first projection into the opening of the frontpiece, rotating the fastener 90° while the first projection is in the opening to secure the first projection within the opening, and mounting the second projection to the headrail.

27 Claims, 3 Drawing Sheets

METHOD AND DEVICE FOR INSTALLING A CORNICE

BACKGROUND OF THE INVENTION

1. Field of the Invention

The present invention relates to a method and a device for installing a cornice to a headrail, and in particular, it relates to a method and a device for installing a cornice to a headrail for venetian blinds.

2. Discussion of Related Art

Window coverings, and in particular, venetian blinds, frequently use a decorative cornice at the top thereof. Although many different types of cornices have been used, one such type includes a relatively flat elongate strip of material fastened to the headrail at the top of the blinds. In the prior art, clips or hook and loop tape have been used to mount such cornices to the headrail. Examples of various attempts to attach a cornice to a headrail are illustrated in U.S. Pat. Nos. 4,254,813; 4,254,814; 3,378,057; 4,399,856; 4,921,031; and 5,062,463.

The prior art methods have been unsatisfactory in that either the fastening means are visible, the fastening is not sufficiently strong to prevent the cornice from occasionally falling, or the fastening means are too complicated to be practical. In addition, none of the prior art fastening means are suitable for use with a wooden cornice. Fastening a wooden cornice to a headrail involves unique problems in that the wooden cornice is relatively heavy, and is not flexible.

OBJECTS AND SUMMARY

An object of the present invention is to provide a method and device for mounting a cornice to a headrail that overcomes the problems of the prior art.

Another object of the present invention is to provide a clip that is suitable for mounting a wooden cornice to a headrail.

Yet another object of the present invention is to provide a device for mounting a cornice to a headrail that is inexpensive to manufacture and convenient to use.

Still another object of the present invention is to provide a clip for mounting a cornice to a headrail that is sufficiently sturdy so that the cornice will not inadvertently fall from the headrail.

These and other benefits of the present invention are accomplished by providing a cornice having an elongate frontpiece that has a decorative front side and a back side, an opening in the back side of the frontpiece, and a clip having a first projection on one side thereof for mounting in the opening of the frontpiece and a second projection on another side thereof for engaging with the headrail so that the frontpiece can be mounted to the headrail by engaging the first projection of the clip with the frontpiece and engaging the second projection of the clip with the headrail.

The cornice can be installed to the headrail by inserting the first projection into the opening of the frontpiece, rotating the clip 90° while the first projection is in the opening to secure the first projection within the opening, and mounting the second projection to a headrail.

DETAILED DESCRIPTION OF THE PREFERRED EMBODIMENTS

Figure 1:
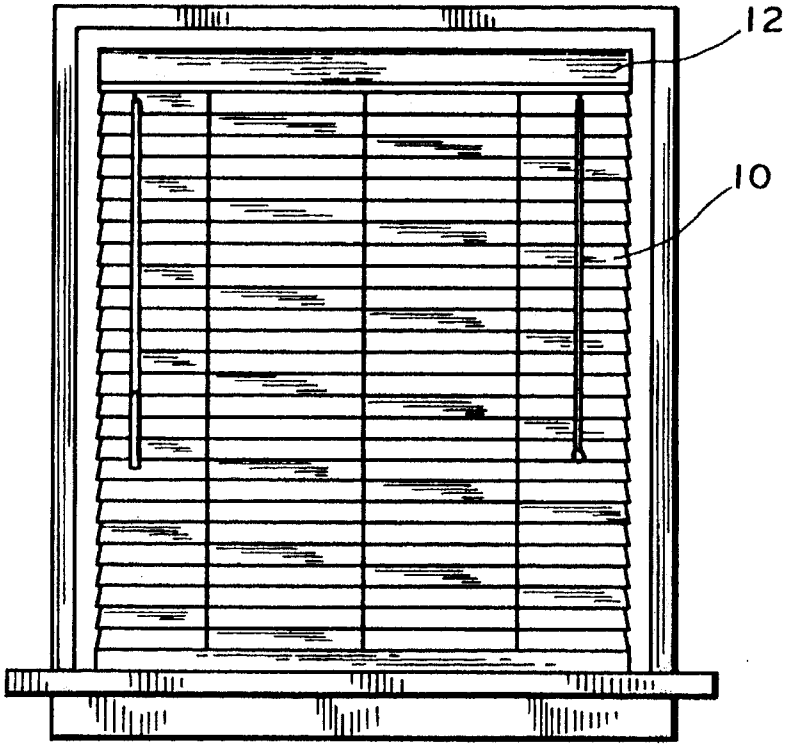
FIG. 1 is a view of a venetian blind having a cornice mounted at the top thereof.

FIG. 1 illustrates a window having venetian blinds 10 covering the window. A cornice 12 is mounted to a headrail 42 (FIGS. 7 and 8) at the top of the venetian blinds 10. Throughout this description, the terms cornice or frontpiece have been used. However, the present invention applies to a valence, as well as any other related structure, in addition to a cornice. Furthermore, all dimensions set forth herein are exemplary, and are not intended to limit the scope of the present invention.

The venetian blinds 10 and the cornice 12 illustrated in FIG. 1 are made of wood. Although the present invention is particularly suited to a wooden cornice 12 used with wooden venetian blinds 10, the present invention is equally applicable to a cornice made of other types of materials.

Figure 3:
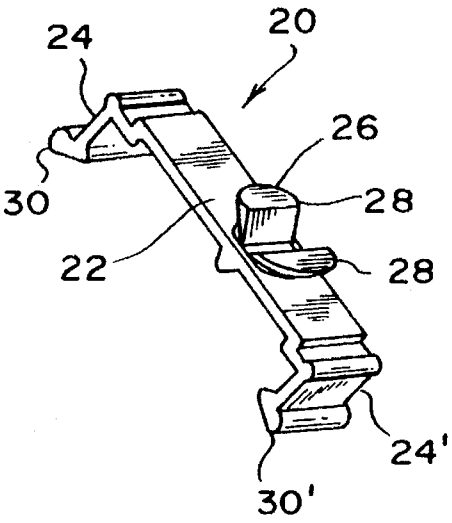
FIG. 3 is a perspective view of a clip used to attach the cornice to a headrail.
Figure 2:
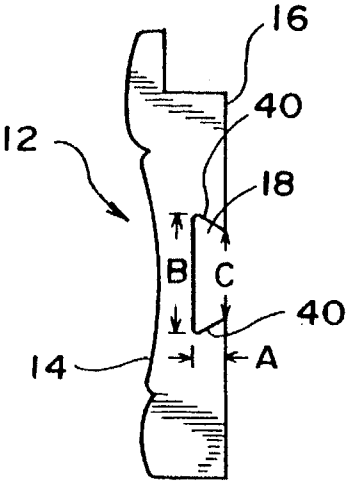
FIG. 2 is a cross-sectional view of the cornice illustrated in FIG. 1.

Turning attention now to FIG. 2, a cross-sectional view of the cornice 12 is illustrated. The cornice 12 includes a decorative front surface 14 and a back side 16. The cornice 12 may be made of any suitable material. However, in a preferred embodiment of the present invention, the cornice 12 is made of wood. In other embodiments, the cornice 12 may be made of plastic, or any other suitable material.

The height of the cornice 12 is preferably within the range of about two to four inches. However, cornices 12 of other heights may also be used in accordance with the principles of the present invention.

On the back side 16 of the cornice 12, a dovetail slot 18 extends along the entire length of the cornice 12. Alternatively, a plurality of dovetail slots 18 may be formed and spaced along the back side 16 of the cornice 12, instead of one long slot 18. In the alternative embodiment, the cornice 12 should have preferably at least two dovetail slots 18. However, more slots 18 may be used, particularly if the cornice 12 is wide.

In a preferred embodiment, the slot 18 has a depth A of about 0.150 inches. At the back of the slot 18, the slot 18 has a height B of 0.526 inches. At the outer extremity of the slot 18, the slot 18 has a height C of about 0.383 inches. Other dimensions may be used and should be easily determined by those of ordinary skill in the art. If a plurality of slots 18 are used, the width of each slot 18, i.e., the extent of the slot as measured in the direction extending into the page in FIG. 2, is preferably slightly greater than 0.557 inches.

Turning attention now to FIGS. 3–6, a fastener or clip 20 is illustrated. The clip 20 is used to fasten the cornice 12 to the headrail 42. The clip 20 includes a flat strip 22. The flat strip 22 has a leg 24, 24' extending from each end thereof.

Near the center portion of the flat strip 22, a projection 26 extends from the flat strip 22. The projection is preferably mounted closer to one leg 24' than the other leg 24. See FIG. 4.

Figure 4:
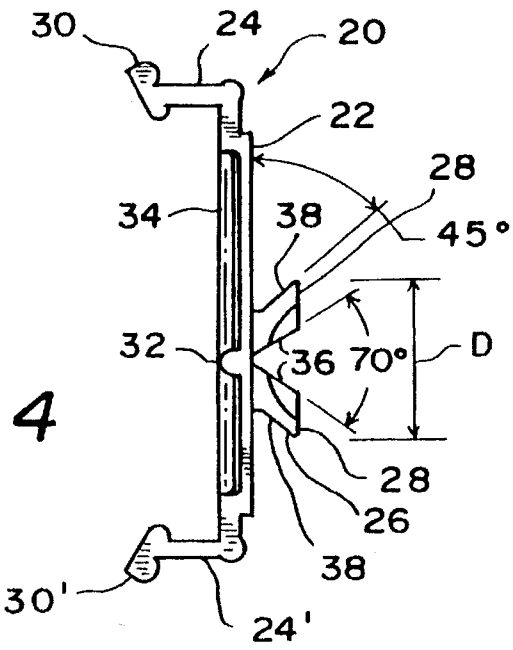
FIG. 4 is a side elevational view of the clip of FIG. 3.
Figure 6:
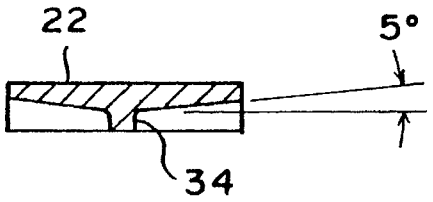
FIG. 6 is a cross-sectional view taken line 6—6 of FIG. 5.

As can be seen more clearly in FIG. 4, the projection 26 includes two legs 28 that extend from the flat strip 22 in a V shape. The two inner surfaces 36 of the projection 26 form an angle of about 70° with respect to each other. Each of the outer surfaces 38 of the projection 26 forms an angle of about 45° with respect to the flat strip 22. The height of the projection 26, i.e., the distance D between the outer extents of each leg 28 is approximately 0.557 inches.

Each of the legs 24, 24' has a foot 30, 30' mounted at the end thereof. The legs 24, 24' and feet 30, 30' are used to engage the headrail 42 mounted at the top of the venetian blinds 10.

Figure 5:
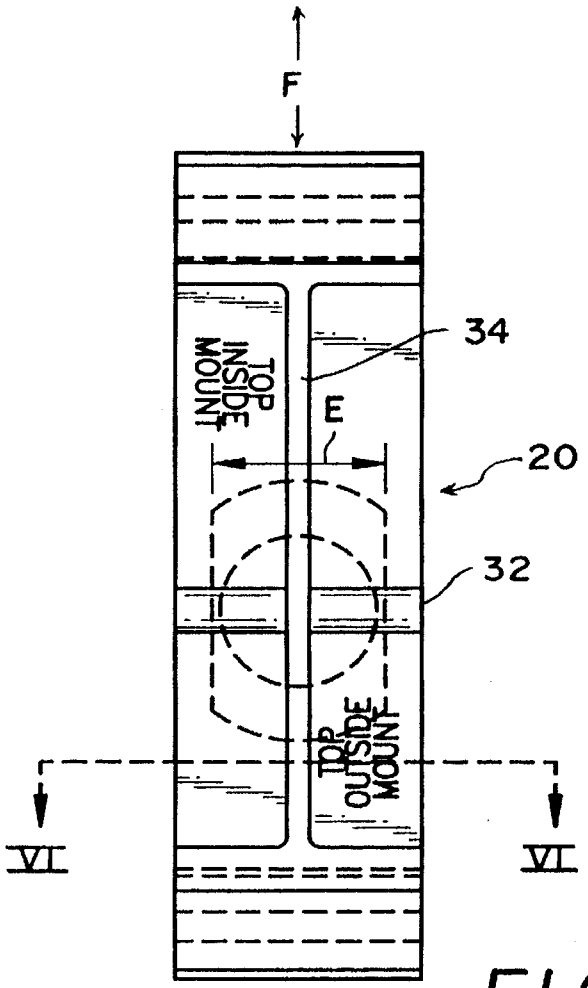
FIG. 5 is a back view of the clip of FIG. 3.

As can best be seen in FIG. 5, ribs 32, 34 are mounted on the underside of the flat strip 22 to provide rigidity to the flat strip 22. Furthermore, as can best be seen in FIG. 6, the back side of the flat strip 22 is not parallel to the front surface. Instead, the side of the clip 20 that is opposite the flat strip 22, includes two surfaces that are angled slightly, i.e., about 5°, with respect to the front side of the flat strip 22.

As illustrated in FIG. 5, lettering may be located on the back of the flat strip 22 to provide guidance for mounting the clip 20.

In a preferred embodiment, the clip 20 is made of a plastic material, such as polycarbonate, that is somewhat flexible. In mounting the clip 20 to the cornice 12, the clip 20 is oriented so that the longitudinal axis F (see FIG. 5) of the clip 20 extends horizontally along the back side 16 of the cornice 12. The projection 26 is then inserted into the dovetail slot 18. The clip 20 is then rotated 90° so that the longitudinal axis F of the clip 20 is extending vertically with respect to the cornice 12. As noted above, the height D of the projection 26 in its relaxed, i.e., unstressed condition, is slightly longer than the height B of the dovetail slot. Accordingly, when the clip 20 is rotated 90°, the two legs 28 of the projection 26 are compressed slightly toward each other so as to cause a tight friction fit within the dovetail slot 18. The friction fit is created by the exterior surfaces 38 of the projection 26 being urged against the interior surfaces 40 of the dovetail slot 18.

After a plurality of clips 20 have been mounted in the dovetail slot 18 on the back side 16 of the cornice 12, the clips 20 are mounted to the headrail 42.

Figure 8:
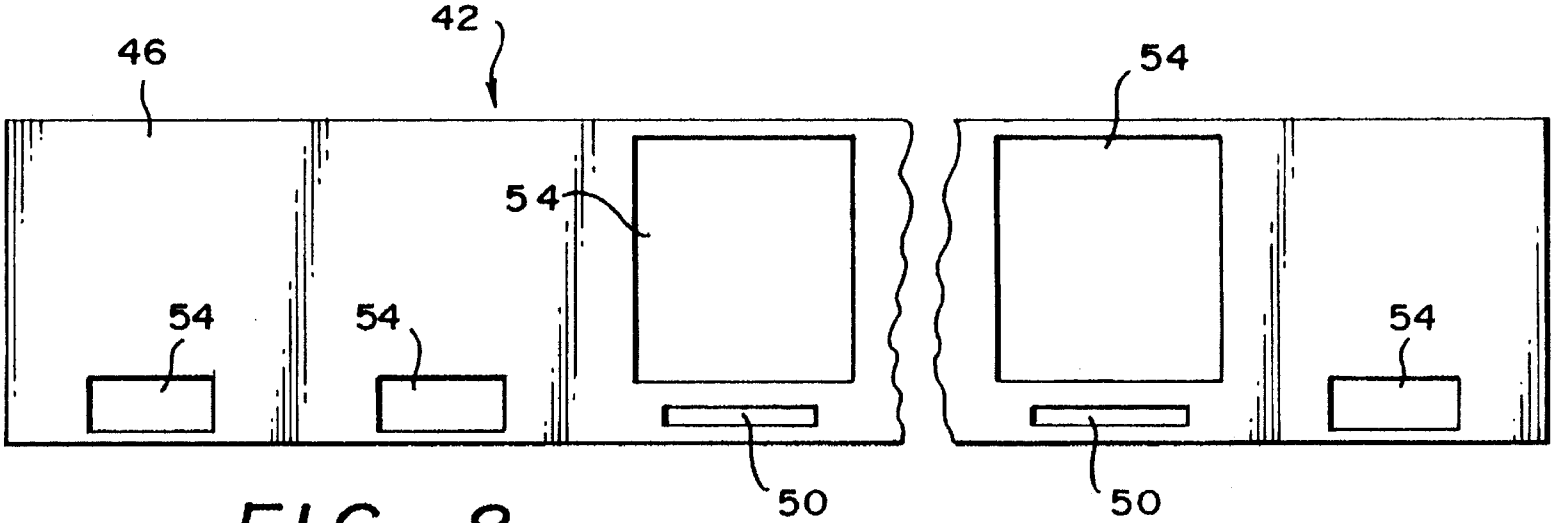
FIGS. 7 and 8 illustrate a headrail designed to be used with the present invention.
Figure 7:
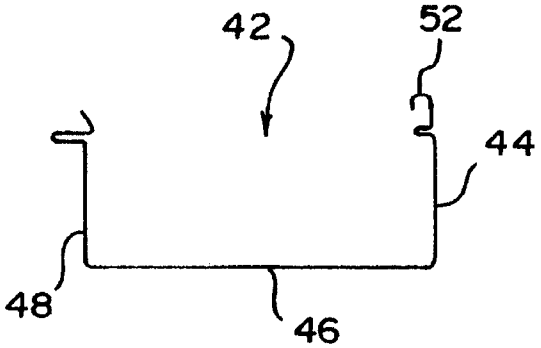

Turning attention now to FIGS. 7 and 8, the headrail 42 to which the cornice 12 is mounted is illustrated. FIG. 7 is a cross-sectional view showing the front side 44, the back side 48, and the bottom 46 of the headrail. When mounted to the window, the back side 48 faces the wall, the front side 44 faces into the room and the bottom 46 faces the floor.

Figure 9:
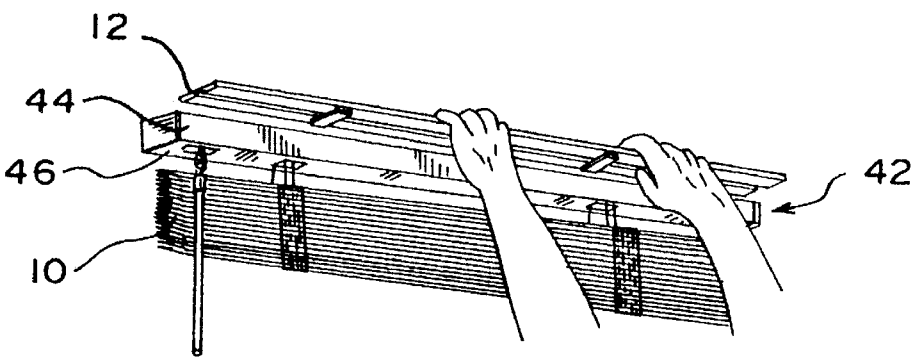
FIG. 9 illustrates installing the cornice to the headrail.

FIG. 8 is a view of the bottom 46 of the headrail 42. Openings 54 enable cords and other paraphernalia for the blinds 10 to extend through the headrail 42. The openings 54 are not used for mounting the cornice 12 to the headrail 42. Extending along the bottom 46 of the headrail are a plurality of openings 50. The openings 50 are relatively narrow and are located adjacent the front surface 44 of the headrail 42. When mounting the clip 20 to the headrail, one of the legs 24 passes over the top 52 of the front surface 44 of the headrail 42. The other leg 24' fits below the headrail 42 and lies flush against a portion of the bottom 46. FIG. 9 illustrates the process of attaching the cornice 12 to the headrail 42. In FIG. 9, the top legs 24 are engaged with the top 52 of the headrail 42, and the lower legs 24' are being lowered toward the bottom 46 of the headrail.

Once mounted, the clip 20 is held in place against the headrail 42 because one of the feet 30 extends beyond the top 52 of the front surface 44 and the other foot 30' fits within the opening 50 in order to lock the clip 20 in place against the headrail 42.

In an alternative embodiment, the headrail 42 may be formed with a ridge extending along the bottom 46 thereof, instead of the plurality of openings 50. In such an embodiment, the lower foot 30' catches on the ridge, instead of engaging with an opening 50.

Once the clips 20 are mounted to the headrail 42, the feet 30, 30' of the clips 20 provide sufficient support to keep the clips 20 from disengaging from the headrail 42. In addition, since the clips 20 are on the back side 16 of the cornice 12, the clips 20 are not readily visible when the cornice 12 is installed to the headrail 42.

Because the legs 24, 24' of the clips 20 straddle the outside of the headrail 42, and do not extend significantly within the headrail 42, the mounting of the cornice 12 to the headrail 42 does not interfere with any of the blind mechanisms within the headrail 42. Furthermore, the present invention enables the cornice 12 to fit flush against the headrail 42.

The projection 26 is not mounted in the exact center of the flat strip 22. Instead, the projection is actually closer to one leg 24' than the other leg 24. The height of the cornice 12, relative to the headrail 42, may be changed by reversing the direction of the clips 20.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A cornice, comprising:

an elongate frontpiece having a decorative front side and a back side;

an opening in the back side of the frontpiece; and a fastener having a first projection on one side thereof for mounting in the opening and a second projection on another side thereof for engaging with a headrail so that the frontpiece can be mounted to the headrail by engaging the first projection of the fastener with the frontpiece and engaging the second projection of the fastener with the headrail, wherein the second projection includes two legs that are vertically reversible so that the fastener can be mounted in either of two positions.

2. The cornice of claim 1, wherein the opening is a dovetail slot.

3. The cornice of claim 2, wherein the first projection includes a pair of flanges that have a shape that corresponds to a shape of the dovetail slot.

4. The cornice of claim 3, wherein the flanges are flexible.

5. The cornice of claim 4, wherein the flanges are V shaped.

6. The cornice of claim 2, wherein the first projection has a shape that corresponds to a shape of the dovetail slot, and has a height that is slightly less than a width of the dovetail slot, so that the fastener may be mounted to the frontpiece by inserting the first projection into the dovetail slot and rotating the fastener 90°.

7. The cornice of claim 6, wherein the first projection is V shaped.

8. The cornice of claim 7, wherein the fastener is plastic.

9. The cornice of claim 1, wherein the first projection is mounted off-center on the fastener so that a height of the cornice may be changed by reversing the fastener.

10. The cornice of claim 7, wherein the first projection is mounted off-center on the fastener so that a height of the cornice may be changed by reversing the fastener.

11. A cornice mountable to a front face of a headrail, comprising:

an elongate frontpiece having a decorative front side and a back side;

a fastener, said fastener including means extending from one side thereof for attaching the fastener to the back side of the frontpiece;

said fastener further including two opposed legs extending from another side of the fastener for engaging with the headrail so that the frontpiece can be mounted to the headrail by engaging the attaching means to the frontpiece and engaging the fastener to the headrail by engaging the headrail with the opposed legs, wherein the two opposed legs are vertically reversible.

12. The cornice of claim 11, wherein the legs are arranged so that when the fastener is attached to the headrail, one leg extends over a top of the headrail and another leg extends under a bottom of the headrail.

13. The cornice of claim 12, wherein the legs of the fastener include feet for catching the top and bottom of the headrail.

14. The cornice of claim 13, wherein the legs of the fastener are flexible.

15. The cornice of claim 12, wherein the frontpiece includes a dovetail slot in the back side thereof and the attaching means includes a projection has a shape that corresponds to a shape of the dovetail slot so that the fastener may be mounted to the frontpiece by inserting the projection into the dovetail slot and rotating the fastener 90°.

16. The cornice of claim 11, wherein the two opposed legs are substantially similar to each.

17. A cornice, comprising:

an elongate frontpiece having a decorative front side and a back side; and a fastener having means on one side thereof for attaching the fastener to the back side of the frontpiece and means on another side of the fastener for engaging the fastener with a headrail so that the frontpiece can be mounted to the headrail by attaching the attaching means to the frontpiece and engaging the engaging means with the headrail;

said attaching means being fixed to said fastener in a location other than a center of the fastener so that the height of the frontpiece, relative to the headrail, may be changed by reversing an orientation of the fastener.

18. The cornice of claim 17, wherein the frontpiece includes a dovetail slot in the back side thereof and the attaching means includes a projection has a shape that corresponds to a shape of the dovetail slot so that the fastener may be mounted to the frontpiece by inserting the projection into the dovetail slot and rotating the fastener 90°.

19. The cornice of claim 18, wherein the engaging means includes legs that are arranged on the fastener so that when the fastener is engaged to the headrail, one leg extends over a top of the headrail and another leg extends under a bottom of the headrail.

20. The cornice of claim 19, wherein the legs of the fastener including feet for catching the top and bottom of the headrail.

21. The cornice of claim 17, wherein the engaging means includes legs that are arranged on the fastener so that when the fastener is engaged to the headrail, one leg extends over a top of the headrail and another leg extends under a bottom of the headrail.

22. The cornice of claim 17, wherein a top half of the engaging means is functionally the same as a bottom half of the engaging means so that the orientation of the fastener may be vertically reversed.

23. The cornice of claim 17, wherein the engaging means is vertically reversible.

24. A method of installing a cornice having an elongate frontpiece with a decorative front side and a back side, an opening in the back side of the frontpiece, and a fastener having a first projection on one side thereof and a second projection on another side thereof, comprising the steps of:

inserting the first projection into the opening;

rotating the fastener while the first projection is in the opening to secure the first projection within the opening; and mounting the second projection to a headrail.

25. The method of claim 24, wherein the first projection includes a pair of opposing flexible flanges and the opening is a dovetail slot configured so that the rotating step causes the flanges to be bent slightly so that the first projection creates a friction fit within the opening.

26. The method of claim 25, wherein the opposing flexible flanges form a V shape and tips of the flanges are urged toward each other when the flanges are bent.

27. The method of claim 24, wherein the fastener is rotated 90° to secure the first projection within the opening.

* * * * *